US006932281B2

(12) United States Patent
Boecking

(10) Patent No.: US 6,932,281 B2
(45) Date of Patent: Aug. 23, 2005

(54) PRESSURE-CONTROLLED DOUBLE-ACTING HIGH-PRESSURE INJECTOR

(75) Inventor: Friedrich Boecking, Stuttgart (DE)

(73) Assignee: Robert Bosch GmbH, Stuttgart (DE)

( * ) Notice: Subject to any disclaimer, the term of this patent is extended or adjusted under 35 U.S.C. 154(b) by 284 days.

(21) Appl. No.: 10/069,729

(22) PCT Filed: Jun. 7, 2001

(86) PCT No.: PCT/DE01/02143

§ 371 (c)(1),
(2), (4) Date: May 20, 2002

(87) PCT Pub. No.: WO02/01067

PCT Pub. Date: Jan. 3, 2002

(65) Prior Publication Data

US 2003/0047619 A1 Mar. 13, 2003

(30) Foreign Application Priority Data

Jun. 29, 2000 (DE) ..... 100 31 574

(51) Int. Cl.[7] ..... F02M 63/00
(52) U.S. Cl. ..... 239/533.2; 239/585.1
(58) Field of Search ..... 239/90, 91, 93, 239/96, 533.2, 533.3, 533.8, 533.9, 585.1–585.5; 123/300, 456, 458, 446, 467, 498, 501; 251/30.02, 44, 50, 54

(56) References Cited

U.S. PATENT DOCUMENTS 5,118,076 A * 6/1992 Homes ..... 251/129.02
5,239,968 A * 8/1993 Rodriguez-Amaya et al. ... 123/506
5,651,346 A 7/1997 Remmels et al.
6,021,760 A 2/2000 Boecking
6,059,204 A 5/2000 Augustin
6,382,189 B1 * 5/2002 Hlousek ..... 123/506

FOREIGN PATENT DOCUMENTS

DE 199 39 447 A 11/2000
WO WO 99 15783 A 4/1999

* cited by examiner

*Primary Examiner*—Michael Mar
*Assistant Examiner*—Thach H. Bui
(74) *Attorney, Agent, or Firm*—Ronald E. Greigg

(57) ABSTRACT

The invention relates to an injector for injecting fuel that is at high pressure into the combustion chambers of an internal combustion engine. A control part which is movable up and down by actuator actuation is received in a bore in the housing of the injector. By means of the actuator, the control part is movable into a position that enables the fuel delivery into a nozzle inlet. The valve chamber in the housing of the injector can be opened and closed during the injection phases by control edges toward the control part, while the pressure relief of the injection system is effected via slide portions disposed on the control part.

9 Claims, 2 Drawing Sheets

PRESSURE-CONTROLLED DOUBLE-ACTING HIGH-PRESSURE INJECTOR

CROSS-REFERENCE TO RELATED APPLICATIONS

This application is a 35 USC 371 application of PCT/DE 01/02143 filed on Jun. 07, 2001.

BACKGROUND OF THE INVENTION

1. Field of the Invention

The invention relates to a double-acting high-pressure injector, which is intended for instance for injection fuel that is at high pressure into the combustion chambers of an internal combustion engine. In certain instances of use, in direct-injection internal combustion engines of large displacement, preinjection phases or postinjection phases may be necessary. The preinjection phase and the postinjection phase make stringent demands in terms of the precision of the triggerability of a control part that controls the injection phases in an injector housing, and in particular in terms of its production variations, if the intended injection courses are to be achieved.

2. Prior Art

German Patent DE 37 28 817 C2 relates to a fuel injection pump for internal combustion engines. In this disclosed fuel injection pump, the control valve member comprises a valve shaft, forming a guide sleeve and sliding in a conduit, and a valve head connected to the valve shaft and oriented toward the actuating device. The sealing face of the valve head cooperates with a face of the control bore that forms the valve seat. The valve shaft has a recess on its circumference, and the axial length of this recess extends from the orifice of the fuel supply line as far as the beginning of the valve head sealing face that cooperates with the valve seat. In the recess, a face exposed to the pressure of the fuel supply line is formed, which is equal in area to a face of the valve head that is exposed to the pressure of the fuel supply line, in the closed state of the control valve. As a result, in the closed state the valve is in pressure equilibrium, and a loading spring that urges the control valve member toward its open position is disposed in the guide sleeve on the control valve member.

With this configuration known from the prior art, it is not possible to achieve a preinjection phase, or a postinjection phase following the main injection phase, into the combustion chambers of an internal combustion engine, since to undertake an additional injection phase, there is no room available to receive the fuel volume to be injected during the preinjection phase or the postinjection phase.

SUMMARY OF THE INVENTION

With the injector proposed according to the invention, using an externally actuatable actuator that achieves two switching positions of the control part, a main injection phase and a preinjection phase, for instance for injecting fuel into the combustion chambers of an internal combustion engine, are possible. Since there is no need for ballistic operation of the control part, the control part can be manufactured to substantially greater precision in terms of its guide and seat diameters.

To achieve the preinjection phase by means of a double-acting injector, the valve chamber of the injector, which can be subjected to fuel at high pressure via a high-pressure collection chamber inlet (common rail inlet), can be used as a throttle gap, given suitable design of the ratio between the valve chamber diameter and the control valve diameter. Thus in a middle position of the head region of the control part with respect to the valve chamber formed in the housing, the flow of fuel in the middle position of the control part in the bore in the housing of the injector can be limited.

When an actuator that positions the control part in two switching stages is used, it is possible in each of the adjustable switching stages, that is, both with the control part open and with it positioned in the middle, to achieve a relief of the nozzle system from the fuel that is at high pressure, via control elements disposed on one and the same control part. The injection nozzle system, and in particular the nozzle inlet and the nozzle chamber that surrounds the nozzle needle, is thus relieved of the fuel that is at high pressure, which reduces the mechanical stress on these components considerably and lengthens the service life of the injector, which achieves two switching states of one control face, considerably as well.

The control part of the injector proposed according to the invention can be designed to be force-balanced, since all the guide and seat diameters have the same diameter. Unevenly distributed mechanical stresses on the control part are thus avoided. If the two control edges provided in the head region of the control part are designed with the same stroke paths, compared to the free overlaps of the slide elements provided on the control part, the flow of leak fuel into the leak fuel line of the housing of the injector proposed according to the invention can be limited, so that there is no adverse effect on the efficiency of the multistage-action injector proposed according to the invention.

BRIEF DESCRIPTION OF THE DRAWINGS

The invention will be described in further detail below in conjunction with the drawings, in which.

DESCRIPTION OF THE PREFERRED EMBODIMENTS

Figure 1:
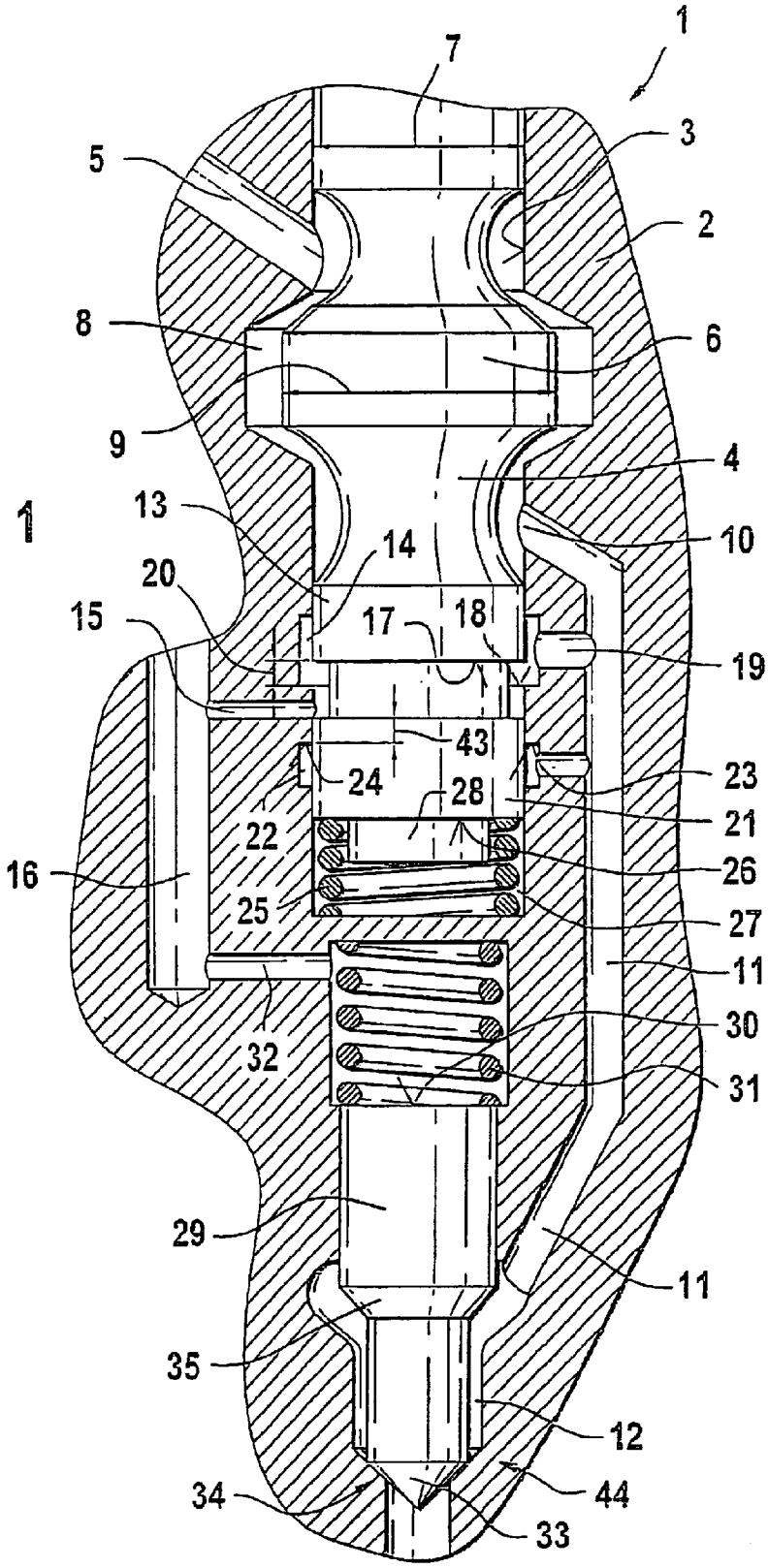
FIG. 1 is a fragmentary longitudinal section through the injector proposed according to the invention, which achieves various injection phases.

FIG. 1 shows a longitudinal section through the injector, proposed according to the invention and achieving various injection phases, for uses involving a high-pressure collection chamber (common rail).

In the housing 2 of the injector 1, a control part 4 is received in a bore 3 extending substantially vertically. By means of an actuator, such as an electromagnet, a piezoelectric actuator, or a mechanical-hydraulic actuator, not shown in detail here and achieving a plurality of switching states, the control part 4 can be moved up and down in the bore 3 of the housing 2. An inlet 5 from the high-pressure collection chamber is provided in the upper region of the injector housing 2; in the region of a constriction of the control part 4, it discharges into the bore 3 in the housing 2 of the injector 1. Below the orifice of the injector 5 from the high-pressure collection chamber, a valve chamber 8 is provided in the housing 2 of the injector 1. The valve chamber 8 is embodied with a valve chamber diameter greater than the diameter 9 of a head region 6 of the control part 4 in the region of the valve chamber 8. In the head region 6 of the control part 4, control edges 36 and 37 toward the control part are embodied both on the upper end of the head region 6 and on its lower end (see the view in FIG. 2).

The seat diameter and the guide diameter on the control part 4, which is embodied rotationally-symmetrically to the axis of symmetry, are all embodied with the same diameter 7. As a result, the control part 4 proposed according to the invention can be designed to be force-balanced.

From the valve chamber 8, which is configured as approximately diamond-shaped in section in the housing 2, a nozzle inlet orifice 10 branches off, connected to which is a nozzle inlet 11, which extends through the injector housing 2 and discharges into a nozzle chamber 12. The nozzle chamber 12 is provided in the front region of an injection nozzle system and with its nozzle tip 33 discharges into the combustion chamber of a direct-injection internal combustion engine.

The head region 6 of the control part 4, which region ends in a constriction of the control part 4, is adjoined downstream by a first slide element 13, whose diameter is equivalent to the diameter 7 in the upper region of the control part 4. The first slide element 13 is surrounded by an annular leak fuel chamber 14 extending annularly around it and embodied in the housing 2 of the injector 1. From the annular leak fuel chamber 14, a leak fuel bore branches off, discharging downstream into a leak fuel line 16. Via the leak fuel line 16, excess fuel flowing out upon nozzle relief from the high pressure can be returned to the fuel tank of the motor vehicle. Also discharging into the annular leak fuel chamber 14 is a first branch from the nozzle inlet 11, by way of which the injection nozzle system, comprising the nozzle inlet 11, nozzle chamber 12 and injection nozzle 34, can be pressure-relieved after an injection phase 41 or 42 (see Fig 3).

The first slide element 13 is adjoined in the axial direction of the control part 4 by a constriction, which in turn is adjoined in the end region of the control part 4 by a second slide element 21. This second slide element 21 is likewise embodied with a diameter 7 with which it is guided in the bore 3 of the housing 2 of the injector 1. The second slide element 21 is likewise surrounded toward the housing by an annular chamber 22 associated with it, which via an opening likewise communicates with the nozzle inlet line 11 in the housing 2. A sealing spring 25 is disposed below an end face 26 of the second slide element 21. The sealing spring 25, embodied as a compression spring, is received in a hollow chamber 27 in the housing 2. It is braced on one end on the bottom of the bore 3 in the housing 2, and on the other, it rests with its terminal winding on an annularly configured annular control face 26 formed by a step 28 on the second slide element 21.

With the aid of the sealing spring 25, the control part 4, operating in at least two stags, is returned to its closing position again after a new actuation by the actuator, so that the inlet 5 from the high-pressure collection chamber is sealed off from the valve chamber 8, and the control part 4 moves upwards in the vertical direction and is placed into its seat that seals off the valve chamber 8.

Underneath the hollow chamber 27 received in the housing 2 of the injector 1 and separately from that hollow chamber, another hollow chamber is formed in which a spring element 31 is received. The spring element 31 received in this hollow chamber acts upon an end face 30 of a nozzle needle 29 and presses the nozzle needle 29 into its nozzle seat 34. A pressure stage 35 is embodied on the nozzle needle 29, in the region that is surrounded by the nozzle chamber 12. When the nozzle inlet 11 is acted upon by fuel at high pressure from the valve chamber 8, the fuel at high pressure is present in the nozzle chamber 12 and causes the nozzle needle 29 to open, moving out of its nozzle seat 34, counter to the action of the spring element 31. As a result, the nozzle tip 33 moves back out of its seat 34, s0 that an injection quantity of fuel at high pressure can be injected into the combustion chamber of a direct-injection internal combustion engine, either during a preinjection phase, during the main injection phase, or during a postinjection phase.

The hollow chamber in which the spring element 31 that acts upon the nozzle needle 29 is received communicates via an outflow line 32 with the aforementioned leak fuel line 16, which via a branch 15 already serves to divert the leak fuel from the annular chambers 14 and 22 provided in the injector housing 2.

The overlap of the stroke paths 20 and 24 at the two downstream leak fuel slide elements 13 and 21, respectively, is equivalent to the stroke of the control edges embodied on the head region 6 of the control part 4.

Figure 2:
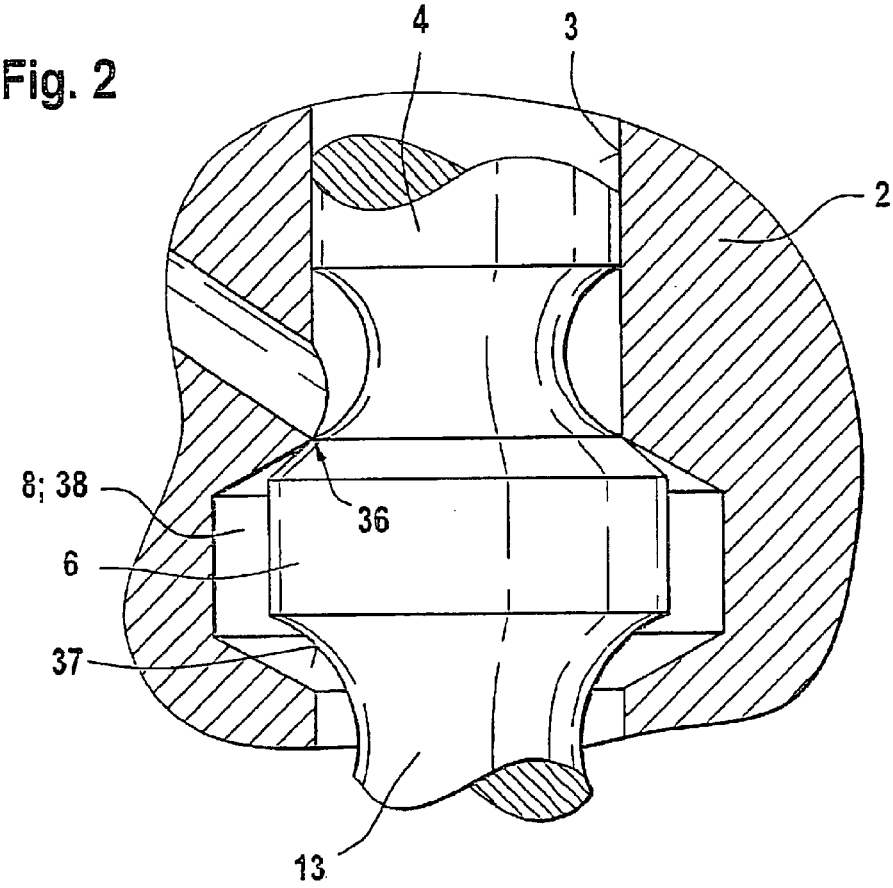
FIG. 2, an enlarged view of the valve chamber at the control part of the injector.

FIG. 2 shows the head region 6 of the control part 4 on an enlarged scale.

The head region 6 of the control part 4, at its upper and lower ends to the guide diameter 7, in which the guide and seat diameters of the control part 4 are embodied, includes two control edges 36 and 37. The degree of overlap of the upper control edge 36 or of the lower control edge 37 corresponds to the stroke paths 20 that can be adjusted at the leak fuel slides 13 and 21, respectively. The enlarged view in FIG. 2 shows that the valve chamber 8 can be designed as a throttle gap 38, on the condition that the inside diameter of the valve chamber 38 and the outside diameter of the head region 6 are appropriately adapted to one another. The end of the gaplike valve chamber 8 and 38 forms the first leak fuel slide 13, which being embodied with the diameter 7 is movable up and down in the bore 3 of the housing 2 of the injector 1.

Figure 3:
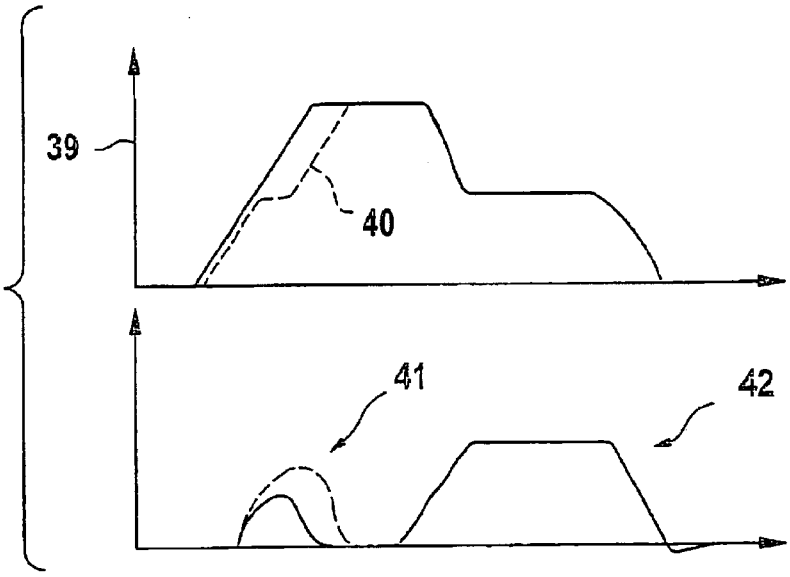
FIG. 3, the courses over time of the control valve stroke and injection phases, each plotted over the time axis.

From FIG. 3, the courses over time of the control part stroke and the injection phases can be seen in more detail, each plotted over the time axis.

In the upper of the two graphs shown in FIG. 3, the stroke path of the control part 4 is plotted in the vertical direction over the time axis. For opening the gaplike valve chamber 8, 38 in order to perform the preinjection, the control part is moved with its head region 4 onto the stop of the housing 2, on which the lower control edge 37 of the head region is seated. To that end, the control part 4 is acted upon by way of an actuator that achieves at least two control states, such as an electromagnet or a piezoelectric actuator. For performing the preinjection, the head region 6 must accordingly execute its longest control path, until the control edge 37 rests on the corresponding control edge of the housing 2 and opens the valve chamber 8, 38.

In the ensuing main injection phase 42 after the preinjection phase 41, the control part 4 is kept approximately in the middle in its position relative to the valve chamber 8, 38 embodied in the housing 2 of the injector 1. This state corresponds to the second plateau, which follows the first, higher-level plateau, as indicated by the curve course in the upper graph of the two graphs of FIG. 3.

In the lower graph, the resultant preinjection phase 41 and main injection phase 42 are shown. The preinjection phase 41 can assume two courses, as shown in the lower graph in FIG. 3. The first course, with a markedly lesser injection quantity, is shown in solid lines, while as an alternative to that the dashed curve shows a preinjection phase 41 which on the one hand lasts longer and during which on the other hand a greater injection volume can be injected. The preinjection phase 41 is followed by an interval between injections, in which the injection nozzle system 11, 12, 34 is pressure-relieved, before a substantially triangular injection course of the injection nozzle can be achieved during the main injection phase.

The mode of operation of the multistage action injector proposed according to the invention is as follows:

The control part 4, supported displaceably in its housing 2 in FIG. 1, is assigned a piezoelectric actuator, electromagnet or similar externally actuatable switching element, with which the control part 4 is movable up and down in its bore 3 in the housing 2 of the injector 1. For performing a preinjection 41, the control part 4 is moved vertically downward by the valve actuation unit, so that the control edge 37, embodied on the underside of the head region 6, takes its seat in the housing 2 and briefly puts the gaplike valve chamber 8, 38 in communication with the inlet 5 of the high-pressure collection chamber. As a result, a fuel quantity corresponding to the preinjection quantity can enter the nozzle inlet 11 via the orifice 10 and thus reach the nozzle chamber 12. Upon the vertically downward-oriented motion of the control part 4, the transverse bores 15, or the further transverse bore located under them, are closed by the leak fuel slides 13 and 21 embodied in the downstream region of the control part 4, so that the nozzle inlet is sealed off from leak fuel during the preinjection phase. This assures that the metered preinjection quantity of fuel is present in the nozzle chamber 12 for performing the injection. As a result of the high pressure prevailing in the nozzle chamber, the nozzle needle 29 moves upward, counter to the spring force of the spring element 31, since the high pressure is present at the pressure stage 35 of the nozzle needle 29. Accordingly, the tip 33 of the injection nozzle is lifted from its seat 34 at the combustion chamber of a direct-injection internal combustion engine, so that fuel can be injected into the combustion chambers of a direct-injection internal combustion engine.

Once the preinjection has taken place, the control part is moved upward vertically, as a result of which the head region 6, embodied as covered is positioned in a middle position inside the valve chamber 8, 38. In the middle position of the head region 6 inside the throttle gaplike valve chamber 8, 38, the annular chambers 14 and 22 in the housing 2, which are provided on the leak fuel side, are closed by the two downstream leak fuel slides 13 and 21, respectively. As a result, in the middle position of the head region 6 inside the valve chamber 8, 38 that functions as a throttle gap, high pressure prevails in the injection nozzle system 11, 12, 34 from the high-pressure collection chamber, via the inlet 5.

The pressure relief after the main injection phase 42 takes place as indicated in the view of FIG. 1, by movement of the head region 6, embodied in thickened form, upward against its upper stop in the housing 2, as a result of the opening of the annular leak fuel chamber 14 by opening of the control edges 17 and 18 on the first leak fuel slide element. Once the preinjection 41 has been performed, the injection nozzle system 11, 12, 13 is pressure-relieved on the leak fuel side by opening of the control edges 24 and 23 on the annular chamber 22, so that the high pressure can be dissipated into the leak fuel line 16 provided on the housing side.

By the design according to the invention of the control part 4 and the design of the valve chamber 8 as a throttle-like gap, with suitable adaptation of the diameters 9 or outer diameters of the chamber 8, two/three-valves can be embodied on the control part 4. The design of the control part with essentially the same diameter in both the guide regions and the seat regions (diameter 7) makes it possible to design the control part 4, which is movable in the bore 3 of the injector housing 2, as force-balanced.

In FIG. 3, with the openable head region 6 of the control part 4, a preinjection stroke and a main injection middle position of the head region 6 in the throttle gaplike valve chamber 8, 38 can be achieved, so that by correspondingly fast or slow triggering of the lower control edge 37 of the head region 6, the injection quantity to be injection during the preinjection phase can be metered. By the design of the diameter ratio of the thickened head region 6 on the control part 4 relative to the inside diameter of the throttle gaplike valve chamber 8, 38, the mean flow into the injection nozzle system 11, 12, 34 taking place from the inlet 5 of the high-pressure collection chamber can be designed accordingly.

By means of the pressure relief via the injection nozzle system 11, 12, 34, a stroke of the nozzle needle 29 that corresponds to a triangular injection course during the main injection phase can be attained.

The foregoing relates to preferred exemplary embodiments of the invention, it being understood that other variants and embodiments thereof are possible within the spirit and scope of the invention, the latter being defined by the appended claims.

What is claimed is:

1. An injector for injecting fuel that is at high pressure into the combustion chambers of an internal combustion engine, the injector comprising a control part (4) guided movably in a housing (2), which control part is movable vertically up and down, actuator-actuated, in a bore (3) of the housing (2) of the injector (1), the control part (4) being actuatable by means of an actuator element which moves the control part (4) into a position that enables the fuel delivery into a nozzle inlet (10, 11), the valve chamber (8, 38) being opened and closed during the injection phases (41, 42) by control edges (36, 37) toward the control part, a pressure relief of the injection nozzle system (11, 12, 34) being effected via leak fuel slides (13, 21) embodied on the control part (4), and wherein, during the preinjection phase (41), the head region (6) of the control part (4) is placed in contact with a second control edge (37) on the housing (2) of the injector.

2. The injector of claim 1, further comprising an actuator that triggers two switching stages disposed above the control part (4).

3. The injector of claim 1, wherein, during the main injection phase (42), the head region (5) of the control part (4) is placed in a middle position relative to the valve chamber (8, 38) surrounding it.

4. The injector of claim 3, further comprising a diameter graduation of the valve chamber diameter (9) to the head region diameter (6), the diameter graduation acting as a throttle and limits the flow in the middle position of the head region (6) of the control part (4) in the valve chamber (8, 38).

5. The injector of claim 1, wherein the coincidence of the stroke paths $h_1$, $h_2$, at the head region (6) of the control part (4) is equal to that of the stroke paths $h_3$, $h_4$ of the slide elements (13, 21) of the control part (4) on the downstream side.

6. The injector of claim 1, wherein the injection nozzle system (11, 12, 34), after the preinjection phase (41), is pressure-relieved to the leak fuel line (16) via an annular chamber (22) on the lower slide element (21).

7. The injector of claim 1, wherein the injection nozzle system (11, 12, 34), after the main injection phase (42), is pressure-relieved via an annular leak fuel chamber (14) provided on the upper slide element (13).

8. The injector of claim 1, wherein all the guide and seat diameters of the control part (4) have the same diameter (7), and wherein the control part (4) is force-balanced.

9. An injector for injecting fuel that is at high pressure into the combustion chambers of an internal combustion engine, the injector comprising a control part (4) guided movably in a housing (2), which control part is movable vertically up and down, actuator-actuated, in a bore (3) of the housing (2) of the injector (1), the control part (4) being actuatable by means of an actuator element which moves the control part (4) into a position that enables the fuel delivery into a nozzle inlet (10, 11), the valve chamber (8, 38) being opened and closed during the injection phases (41, 42) by control edges (36, 37) toward the control part, a pressure relief of the injection nozzle system (11, 12, 34) being effected via leak fuel slides (13, 21) embodied on the control part (4), wherein the injection nozzle system (11, 12, 34), after the preinjection phase (41), is pressure-relieved to the leak fuel line (16) via an annular chamber (22) on the lower slide element (21), and wherein the injection nozzle system (11, 12, 34), after the main injection phase (42), is pressure-relieved via an annular leak fuel chamber (14) provided on the upper slide element (13).

* * * * *